United States Patent [19]

Lemme

[11] Patent Number: 5,031,785

[45] Date of Patent: Jul. 16, 1991

[54] COMBINATION VACUUM/PRESSURE PUMP AND VALVE STOPPER FOR FOOD OR DRINK CONTAINERS

[75] Inventor: Anthony R. Lemme, Wallingford, Conn.

[73] Assignee: Epicurean International Corp., Wallingford, Conn.

[21] Appl. No.: 511,328

[22] Filed: Apr. 19, 1990

Related U.S. Application Data

[63] Continuation-in-part of Ser. No. 479,966, Feb. 14, 1990, abandoned.

[51] Int. Cl.[5] ..... B65D 51/16

[52] U.S. Cl. ..... 215/228; 215/260; 215/311; 141/65; 417/547; 417/553; 417/554

[58] Field of Search ..... 215/228, 260, 311; 220/212, 240; 141/65; 137/526; 417/547, 550, 552, 553, 554

[56] References Cited

U.S. PATENT DOCUMENTS

| | | |
|---|---|---|
| 48,401 | 6/1865 | Hill . |
| 55,022 | 5/1866 | Stanles . |
| D. 296,522 | 7/1988 | Schneider . |
| D. 296,524 | 7/1988 | Schneider . |
| 347,095 | 8/1886 | Doherty . |
| 515,626 | 2/1984 | Stutzer et al. . |
| 795,642 | 7/1905 | Nelson . |
| 847,785 | 3/1907 | Kleineberg . |
| 943,951 | 12/1909 | Moody . |
| 1,384,780 | 7/1921 | Sager . |
| 1,490,637 | 4/1924 | Sager . |
| 1,641,501 | 9/1927 | Post et al. . |
| 1,674,345 | 6/1928 | Rusler . |
| 1,940,721 | 12/1933 | Martin . |
| 2,049,872 | 8/1936 | Sera . |
| 2,070,377 | 2/1937 | Simmons . |
| 2,168,734 | 8/1939 | Freeman . |
| 2,436,849 | 3/1948 | Billetter . |
| 2,534,504 | 12/1950 | Engstrom . |
| 2,648,474 | 8/1953 | Crook . |
| 2,729,381 | 1/1956 | Wiser . |
| 2,967,571 | 1/1961 | Haessler . |
| 3,084,823 | 4/1963 | Reichstein . |
| 3,229,864 | 1/1966 | Roder . |
| 3,557,986 | 1/1971 | Poole . |
| 3,594,103 | 7/1971 | Hillis . |
| 3,602,387 | 8/1971 | Patnaude . |

(List continued on next page.)

FOREIGN PATENT DOCUMENTS

| | | |
|---|---|---|
| 1245195 | 11/1988 | Canada . |
| 0234607 | 4/1989 | European Pat. Off. . |
| 623620 | 12/1935 | Fed. Rep. of Germany . |
| 541622 | 7/1922 | France . |
| 931126 | 2/1948 | France . |
| 200360 | 10/1938 | Switzerland . |
| 345553 | 3/1960 | Switzerland . |
| 1046518 | 10/1966 | United Kingdom . |

*Primary Examiner*—Stephen Marcus
*Assistant Examiner*—Stephen Cronin
*Attorney, Agent, or Firm*—DeLio & Associates

[57] ABSTRACT

A combination pressure and vacuum pump for food or drink containers including a pump housing having a pump cylinder therein, a pump head adapted for sealing engagement with a valve stopper on a food or drink container, and a piston in sliding airtight engagement with the pump cylinder; the pump cylinder, pump head and piston defining a pump chamber. A handle is provided for moving the piston and the pump cylinder relative to one another to pump a gas into or out of the food or drink container. The pump chamber is connected to the valve stopper via a first opening when the pump head is sealed to the valve stopper and to the atmosphere via a second opening through a combination pressure and vacuum valve, the combination valve being switchable from a vacuum position to a pressure position.

A combination pressure and vacuum valve stopper is also shown which includes a valve element reversible between a pressure position and a vacuum position to convert the stopper between pressure and vacuum use.

36 Claims, 3 Drawing Sheets

U.S. PATENT DOCUMENTS 3,670,915 6/1972 Forman .
3,672,114 6/1972 Sacks .
3,822,720 7/1974 Souza .
4,142,645 3/1979 Walton .
4,249,583 2/1981 Lundbladh .
4,278,114 7/1981 Ruberg .
4,287,819 9/1981 Emerit .
4,524,877 6/1985 Saxby et al. .
4,558,795 12/1985 Logue .
4,583,925 4/1986 Hawkins .
4,627,796 12/1986 Moore .
4,699,190 10/1987 Bates .
4,763,802 8/1988 Johnston .
4,763,803 8/1988 Schneider .
4,768,665 9/1988 Ballas .
4,823,968 4/1989 Handzlik .
4,889,250 12/1989 Beyer .
4,899,896 2/1990 Metzger .
4,911,314 3/1990 Schneider .

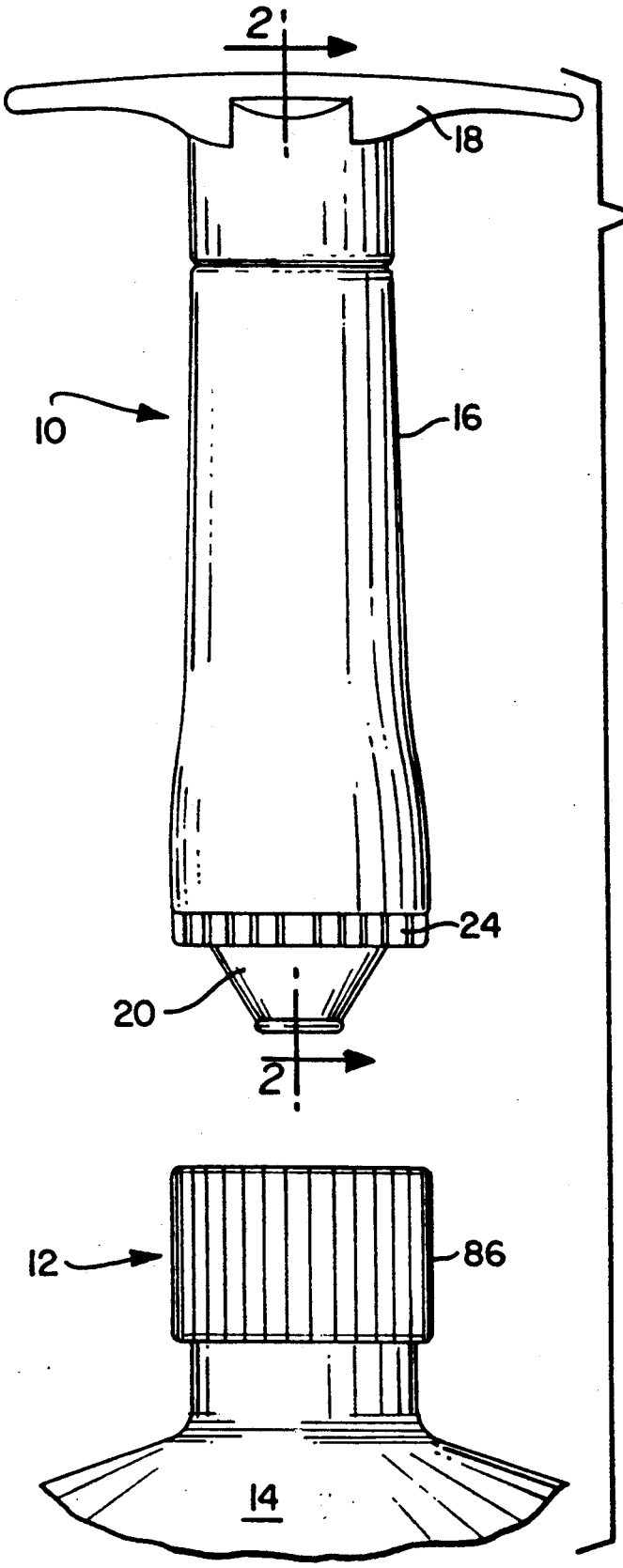
FIG. 1
FIG. 2
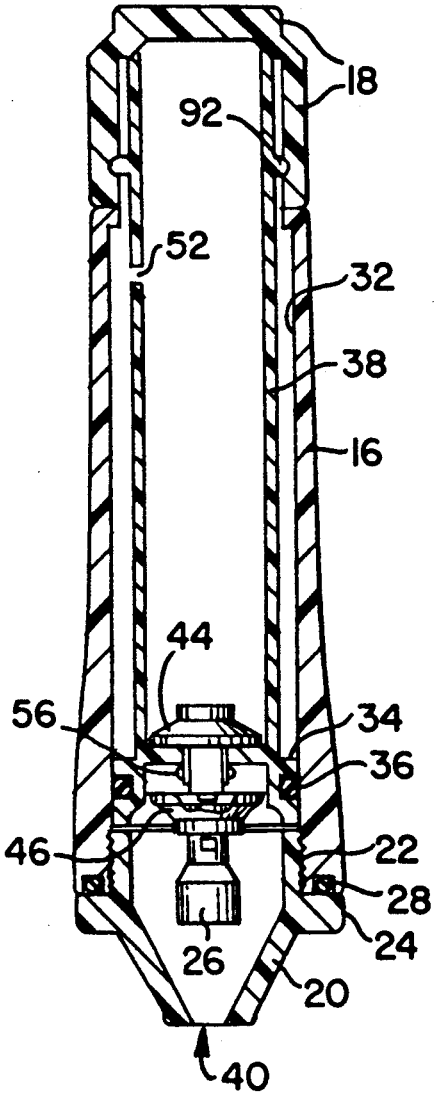

COMBINATION VACUUM/PRESSURE PUMP AND VALVE STOPPER FOR FOOD OR DRINK CONTAINERS

BACKGROUND OF THE INVENTION

This is a continuation-in-part of Ser. No. 479,966, filed Feb. 14, 1990 now abandoned.

1. Field of the Invention

This invention relates to hand operated pumps for pressurizing and evacuating food or drink containers and to one-way vacuum and pressure valve stoppers used in conjunction with such pumps to maintain the generated pressure or vacuum.

2. Related Art

It is well known that certain beverages and foods, such as wine and ground coffee, are preserved best under a vacuum, while others, such as carbonated soda and sparkling wines, do best under pressure. Vacuum storage removes the air and prevents oxidation of the food or beverage which is a principal cause of food deterioration. Conversely, liquids such as carbonated beverages and sparkling wines need pressure storage to prevent the escape of the gaseous material.

These contrasting food/beverage storage requirements have heretofore been met separately. For example, U.S. Pat. Nos. 4,763,803; 4,249,583; 4,142,645; and 2,049,872 show vacuum pumps, operable with suitable one-way valve vacuum stoppers, for removing the air from food or beverage containers.

Pressure pumps suitable for use with pressure valve stoppers such as are shown in U.S. Pat. No. 3,084,823 are also known.

However, the storage and use of separate vacuum and pressure pumps, and separate vacuum and pressure valve stoppers is inconvenient.

Accordingly, a principal object of the present invention is to provide a single pump which may be used in both a pressure and a vacuum configuration.

A second object of the invention is to provide a valve stopper for use with food and beverage containers which may be reversed between a pressure and a vacuum configuration.

Still another object of the invention is to provide a valve stopper which may be easily activated to release the vacuum or pressure within the food or drink container and permit removal of the stopper.

SUMMARY OF THE INVENTION

The above objects and other objects which will be apparent to those skilled in the art are achieved in the present invention which provides a combination pressure and vacuum pump for food or drink containers. The pump comprises a pump housing containing a pump cylinder, a pump head adapted for sealing engagement with a valve stopper on a food or drink container, a piston in sliding airtight engagement with the pump cylinder, and a handle adapted for hand pumping to move the piston and the pump cylinder relative to one another. The pump cylinder, pump head and piston define a pump chamber, including a first opening which connects to the valve stopper when the pump head is sealed to the valve stopper for pumping a gas into or out of the food or drink container, and a second opening which connects to the atmosphere through a combination pressure and vacuum valve. The combination valve is switchable from a vacuum position to a pressure position. The invention also comprises a combination pressure and vacuum valve stopper for food and beverage containers which includes a stopper element which seals to the opening in the food or beverage container and to the pump head. The stopper includes a valve opening through the stopper for the passage of air into or out of the food/drink container, and a valve element which is retained by the valve opening in the stopper. The valve opening is reversable between a pressure position and a vacuum position to seal the valve opening in the two orientations.

The invention also comprises the combination of the pressure/vacuum pump and the reversable pressure/vacuum valve stopper.

BRIEF DESCRIPTION OF THE DRAWINGS

FIG. 1 is a front elevational view of the combination vacuum and pressure pump of the present invention positioned above a stopper valve on a beverage container.

FIG. 2 is a cross sectional view along the line 2-2 in FIG. 1 showing the pump of the invention with the switchable vacuum/pressure valve in the vacuum position, the pump handle being shown in solid line in the lowered position.

DETAILED DESCRIPTION OF THE INVENTION

Figure 4A:
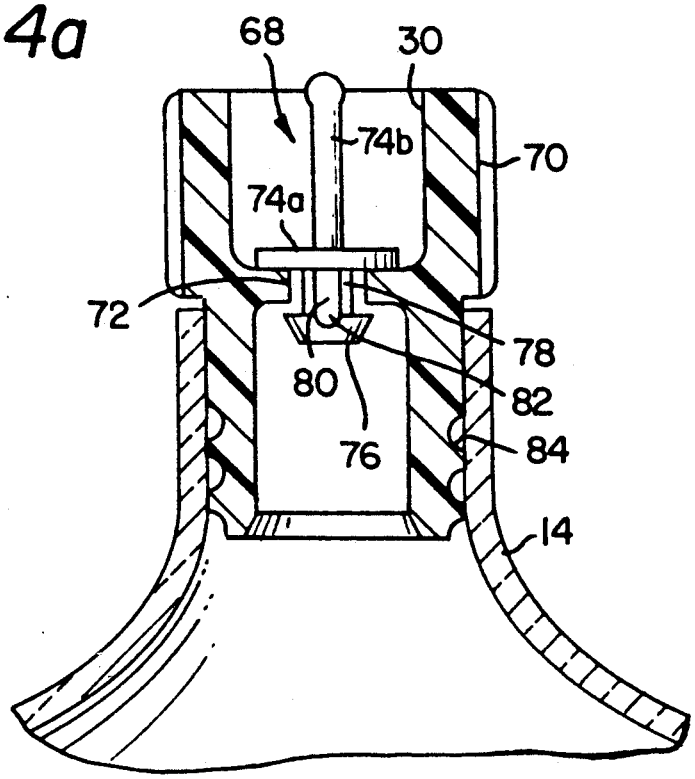
FIG. 4*a* shows an alternate embodiment of the one way stopper depicted in FIG. 4.
Figure 4:
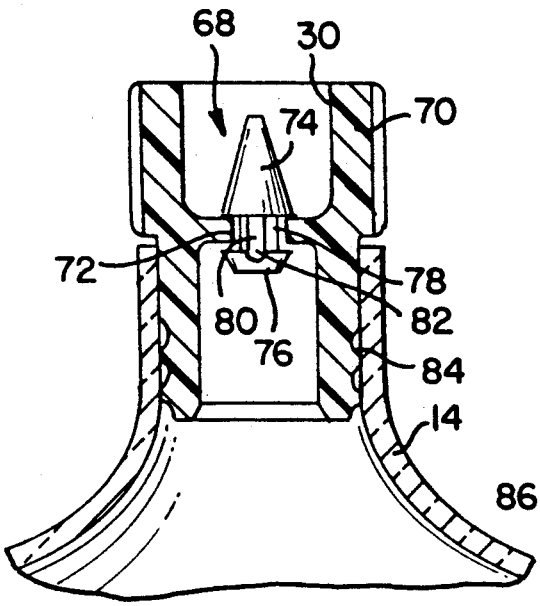
FIG. 4 shows a one-way valve stopper in the vacuum configuration according to the present invention.
Figure 5:
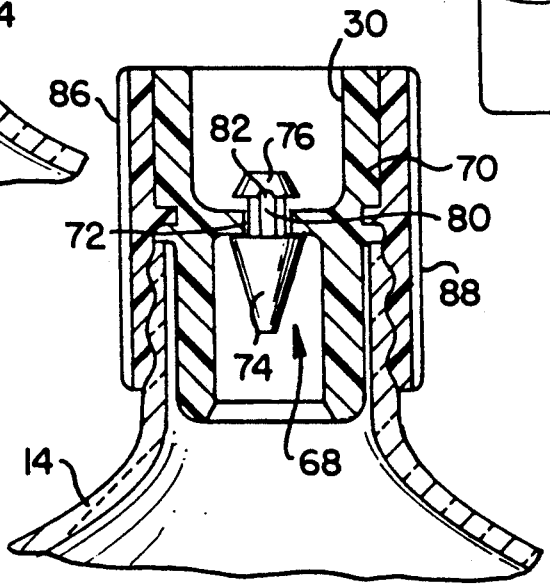
FIG. 5 shows a screw cap one-way pressure valve stopper in the pressure configuration according to the present invention.

The combination vacuum/pressure pump shown in FIGS. 1-2 operates in conjunction with the vacuum/pressure valve stoppers shown in FIGS. 4-5 to pressurize or evacuate food and drink storage containers. Both the pump and the valve stoppers are switchable between pressure and vacuum operation for maximum flexibility of the food preservation system.

Referring to FIG. 1, the combination vacuum/pressure pump is indicated generally by reference numeral 10. The corresponding valve stopper 12 is shown below the pump 10 just prior to engagement of the two for pressurizing or evacuating the food storage container 14. The pump comprises a housing 16, a handle 18, and a pump head 20.

Referring to FIG. 2, the pump head 20 is threadably attached to the interior of the pump housing 16 via threads 22. A knurled ring 24 formed on the perimeter of the pump head 20 permits the pump head to be easily unthreaded and removed from the pump housing 16. This provides access to knob 26 which is pushed longitudinally to switch the pump from the vacuum pump position (shown in FIG. 2) to the pressure pump position (shown in FIG. 3). The pump head is sealed to the pump housing by O-ring 28.

The pump head 20 is adapted for sealing engagement with the valve stoppers of FIGS. 4–5. The exterior of the pump head 20 is conical and tapers from the outer diameter of the pump housing towards the centerline of the pump adjacent to the valve stopper. This conical design permits the pump head 20 to seal against the inner lip 30 of the valve stoppers of FIGS. 4 and 5. Although this conical sealing system is preferred because it fits varying internal diameters of one-way valve stoppers, alternative configurations are also suitable in which the pump engages the exterior of the valve stopper or in which a face-to-face or clamping seal is provided.

The housing 16 incorporates cylinder 32 within its interior. Piston 34 slides longitudinally within the cylinder 32 as the pump handle is moved between the lowered position seen in FIG. 2 and a raised position (not shown). The piston includes a resilient sealing ring 36 which forms an airtight seal between the piston 34 and the cylinder 32.

Piston rod 38 connects the piston 34 to the handle 18. In the embodiment of FIG. 2, the piston rod 38 is hollow and forms a single piece with piston 34. However, in the more highly preferred embodiment seen in FIGS. 6–7, in which like numerals designate like features, the piston rod 38 has an "X" shaped cross section and is threadably attached to a separate piston.

The cylinder 32, piston 34, and pump head 20 define a pump chamber which increases and decreases in volume as the piston is pumped up and down. The pump chamber is connected to the interior of the food/drink container 14 through a first opening 40 which passes through the pump head which is in turn sealed to the valve stopper. The second opening 42 to the pump chamber is through the combination pressure and vacuum valve (shown in detail in FIG. 3) which connects the pump chamber to the atmosphere. The combination vacuum/pressure valve is preferably mounted on the piston 34, but may alternatively be mounted elsewhere so as to connect the pump chamber to atmospheric pressure through the switchable valve.

Figure 3A:
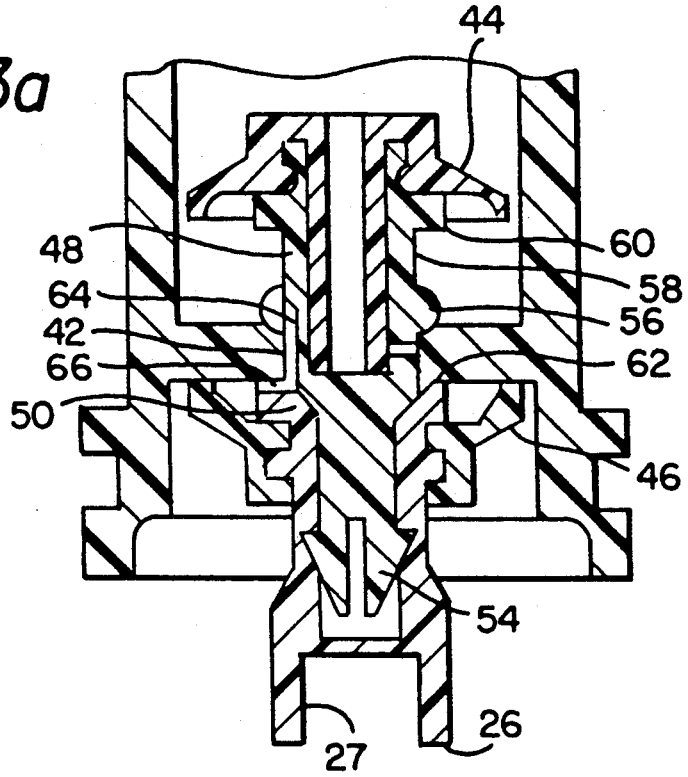
FIG. 3*a* shows an alternate embodiment of the pump valve depicted in FIG. 3.
Figure 3:
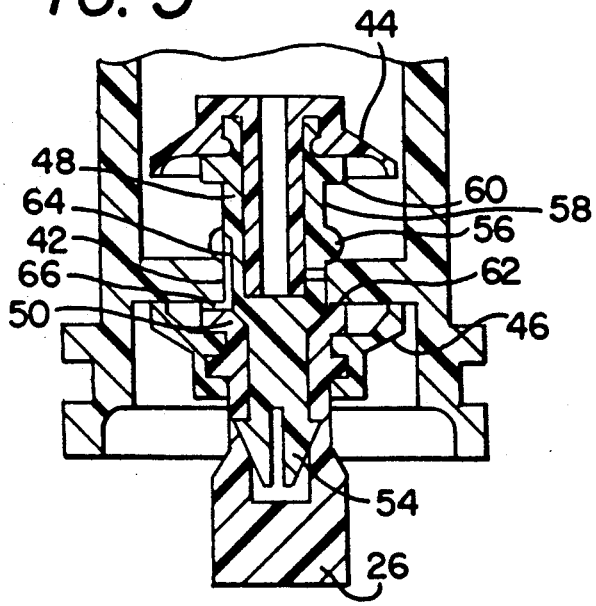
FIG. 3 shows a detail cross sectional view of the switchable vacuum/pressure dual mushroom (or "umbrella") pump valve in the pressure position and the piston on which the valve is mounted.

As may be seen in FIG. 2, and in greater detail in FIG. 3, the pump valve comprises a dual mushroom valve longitudinally slidable between a pressure and a vacuum position.

The two mushroom valve elements 44, 46 include flexible sealing skirts at their perimeters and are mounted opposite one another along the valve rod formed of the vacuum valve rod portion 48 and the pressure valve rod portion 50. During vacuum operation, the valve rod 48, 50 is in the position seen in FIG. 2. The sealing skirt of the vacuum mushroom valve element 44 seals against the upper surface of the piston 34. During vacuum operation, the pressure mushroom valve element 46 serves no function.

Prior to pressure operation, the valve rod 48, 50 is moved longitudinally upwards to the position shown in FIG. 3 such that the sealing skirt on the pressure mushroom valve element 46 contacts the opposite surface of the piston 34. During pressure operation, the vacuum mushroom valve element 44 serves no function.

The valve rod portion 48 projects through opening 42 in the piston 34 to connect the pump chamber to the atmosphere. In the embodiment of FIG. 2, the interior of the piston rod 38 is open to the atmosphere through a pressure relief hole 52. In the embodiment seen in FIGS. 6 and 7, a separate pressure relief hole is not required as the piston rod 38 is directly open to the atmosphere.

Knob 26 is formed as part of the pressure valve rod portion 50 and moves the entire valve assembly longitudinally to bring the vacuum mushroom valve element 44 and the pressure mushroom valve element 46 into and out of contact with the upper and lower faces of the piston 34. In an alternate embodiment depicted in FIG. 3*a*, knob 26 includes a downwardly extending annular sleeve having a central opening 27. As will be discussed below, this central opening prevents interference of knob 26 with an alternate embodiment of the stopper with which the pump is used.

In the preferred design, the complete valve assembly comprises four components, namely the vacuum and pressure mushrooms 44, 46, the (upper) vacuum valve rod portion 48 and the (lower) pressure valve rod portion 50 which incorporates the knob 26.

The mushroom valves 44, 46 are positioned on their respective valve rod portions which are then assembled through the second opening 42 in the piston 34 by inserting the arrowhead lock 54 on the vacuum valve rod portion 48 into a mating receptacle in the interior of the pressure valve rod portion 50.

The valve rod includes detent bumps 56 mounted at the ends of flexible fingers 58 which are longitudinally aligned with the axis of the valve rod. The fingers 58 and valve rod portions 48, 50 are formed of a plastic which is resilient and permits the fingers 58 to bend radially inward, swinging the detent bumps out of the way as the valve is moved from the pressure to the vacuum position.

The valve rod portions 48, 50 include annular stop rings 60, 62 which prevent the valve rod from passing through the opening 42 in the piston and provide a convenient mount for the mushroom valve elements 44, 46.

As is customary in mushroom valves, the valve rod portion 48 includes longitudinally aligned air passageways 64 which permit air to pass through the opening 42 during the pressure and/or vacuum strokes. The longitudinal passageways 64 connect to radial passageways 66 on the surface of the annular stop rings so that the stop rings do not obstruct the air flow. Instead of or in addition to air passageways 64, other openings may be provided in the piston adjacent to opening 42 to permit passage of air.

The complexity of the dual mushroom valve shown in FIG. 3 somewhat obscures the longitudinal 64 and radial 66 air passages. Their function may be better understood by reference to the mushroom valve employed in the valve stoppers seen in FIGS. 4, 4*a* and 5. In these figures, a simple one-piece mushroom valve is indicated with reference numeral 68.

The valve stopper in FIG. 4 is shown in the vacuum configuration and comprises a resilient stopper 70 adapted to contact and seal the opening in a food or drink container 14. A central opening 72 in the stopper 70 loosely holds the mushroom valve 68.

The mushroom valve 68 includes a large head portion 74 connected to a smaller stop button 76 via valve rod 78. The mushroom head portion 74 corresponds in function to the mushroom valves 44, 46 in FIG. 3 and acts to seal the valve stopper by making sealing contact around the perimeter of opening 72.

As air is evacuated from the food container 14, the mushroom head portion 74 rises up, and stop button 76 acts to retain the mushroom valve 68 in opening 72. In the absence of longitudinal passageway 80 or radial passageway 82, the valve rod and retaining button would obstruct the flow of air or gas out of the food/-drink container 14. In the alternative, the valve rod may be constructed with a smaller diameter than opening 72, in which case the retaining button 76 should have grooves or openings to allow air passage around the rod.

Similar longitudinal and radial passageways 64, 66 are incorporated in the valve rod portions 48, 50 and on the inner faces of the stop rings 60, 62 of the dual mushroom pump valve to permit air flow during the corresponding vacuum and pressure strokes. The stopper 70 includes a lower half adapted to contact the interior of a wine bottle neck or food container opening and an upper half of a larger diameter which rests upon the rim of the container. Ridges 84 help provide an airtight seal with the interior of the food container.

The inner lip 30 of the stopper has a diameter intermediate the minimum and maximum diameters of the conical pump head 16 so as to provide an airtight seal as the pump is pressed against the stopper during pumping.

The mushroom head portion 74 is provided with an extended tip at its upper end which allows the mushroom valve to be rocked to one side or the other which releases the vacuum and allows removal of the stopper 70. In the alternate embodiment depicted in FIG. 4*a*, mushroom valve 68 operates in the same manner previously described, but includes a head portion having a flat, disk shaped sealing portion 74*a* which seals around the perimeter of opening 72 and an upwardly extending shaft portion 74*b* whose tip extends to or above the top edge of stopper inner lip 30 for easier access for rocking and opening valve 68. It is preferred that the embodiment of pump know 26 having relief area 27 as shown in FIG. 3*a* be utilized with the stopper embodiment shown in FIG. 4*a* to avoid any potential interference by permitting the top of valve 68 to be received within the open area of knob 26.

FIG. 5 shows a similar valve stopper in the pressure configuration, in which like components have been designated with like numerals. However, in this configuration the stopper 70 has been retained inside a threaded cap 86 which is attached via threads 88 to the top of a threaded food or beverage container. For example, the cap may be provided with threading to match carbonated soda bottles or to fit the top of a champagne bottle, or a specially manufactured food or beverage container may be provided.

It will be noted that the mushroom valve 68 in FIG. 5 is identical to, but reversed from, the mushroom valve of FIG. 4. This illustrates one of the principal advantages of the present invention in which the mushroom valve 68 may be reversed by pulling it out of the opening 72 and inserting it in the revised orientation. This switches the stopper valve from pressure stopper operation as seen in FIG. 5 to vacuum stopper operation as in FIG. 4. Although the threaded stopper attachment method of FIG. 5 is preferred for both pressure and vacuum stopper operation, the simple unthreaded stopper of FIG. 4 may also be used in the pressure mode, particularly where the neck of the beverage container narrows towards the outlet of the bottle, where a rough surface on the interior of the neck is provided, or where only a low pressure needs to be maintained.

Figure 6:
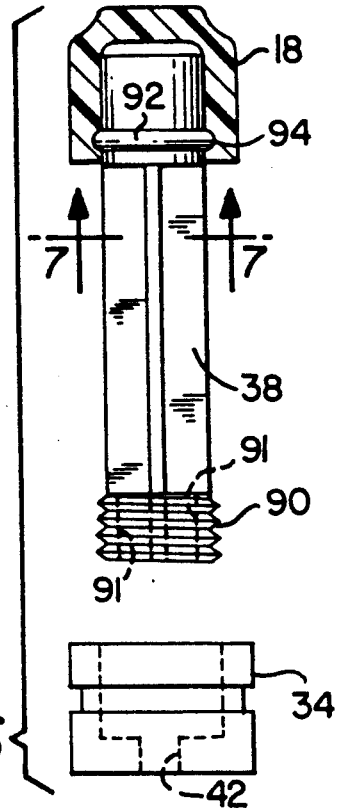
FIG. 6 shows a front elevational dissassembled view of the preferred embodiment of the piston rod and piston of the present invention with the handle being shown in cross section to illustrate its connection to the piston rod.
Figure 7:
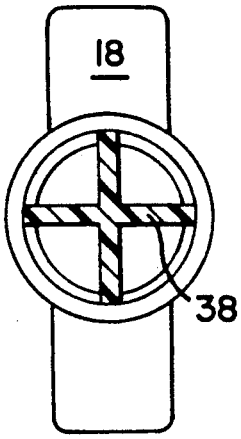
FIG. 7 shows a cross sectional view of the piston rod and pump handle along the line 7—7 in FIG. 6.

FIGS. 6 and 7 show the preferred embodiment of the piston rod 38, piston 34 and handle 18. The lower end of the piston rod 38 in FIG. 6 includes threads 90 which engage corresponding threads on the interior of piston 34. Openings 91 extend through the lower threaded portion of piston rod 38 to permit air passage between the exterior of rod 38 and piston opening 42. The upper end of the piston rod is cylindrical and contains a bump ring 92 which engages a groove 94 on the inner surface of handle 18 so that they may be snapped together. The pump rod 38 has been shown in elevation in FIG. 7, and the handle 18 has been shown in cross section to illustrate this interconnection method.

FIG. 7 is taken along the cross sectional line 7—7 in FIG. 6 and shows the "X" shape of the piston rod 38. The "X" shape provides direct access to the atmosphere, as required for the dual mushroom valve. Moreover, the "X" configuration provides greater clearance from the interior surface of the cylinder 32 which prevents damage due to dirt or sand being trapped between the exterior of the piston rod and the interior of the cylinder 32. In the preferred design, this debris falls into the interior of the piston where it is retained until the unit is cleaned without damage to the inner surface of the cylinder. Moreover, the piston may be unthreaded from the piston rod which makes cleaning the pump much easier, and also allows the pump to be modified or fitted with new valves or different valve configurations.

The operation of the pump and stopper combination may now be described in greater detail. A stopper of the type seen in FIGS. 4 or 5 is selected which is suitable for the beverage/food container to be used. The container may be a conventional wine bottle, or it may be a food container specially prepared for use in combination with the threaded stopper of FIG. 5. If necessary, the mushroom valve 68 in the selected stopper may be reversed to change the stopper operation from pressure to vacuum.

The pump 10 is then set for pressure or vacuum operation by unthreading the pump head 20, and sliding the knob 26 longitudinally into the appropriate pressure or vacuum position. The pump head 20 is then reattached to the pump housing and tightened to seal the 0-ring 28. The pump is next positioned so that the conical position of the pump head 20 seals against the inner surface 30 of the selected valve stopper. The handle 18 is then grasped firmly and pumped up and down until resistance is felt and the desired pressure or vacuum is achieved.

During vacuum operation, with the knob 20 in the position shown in FIG. 2, as the handle and piston are raised, air flows out of the food container through opening 72 and the radial and longitudinal passages 80, 82 in the stopper valve 68 and into the pump chamber through opening 40 in the pump head. As the handle is lowered, the stopper valve 68 seals against stopper 70 and the air which has entered the pump chamber through opening 40 exits the pump chamber through opening 42 by flowing through the radial and longitudinal passageways 64, 66 and out under the flexible skirt at the perimeter of the mushroom valve element 44. The cycle is then repeated until the desired vacuum is achieved.

Pressure operation is identical except that the dual mushroom valve is moved to the position seen in FIG.

3, and the stopper valve is moved to the position shown in FIG. 5. Air is pumped initially into the pump chamber as the piston is raised, and out of the pump chamber through opening 40 into the food container as the pump handle is lowered.

The pump housing 16, handle 18, pump head 20, piston rod 38 and piston 34 are preferably made of a strong, impact resistant plastic such as Acrylonitrile-Butadiene-Styrene (ABS). The valve rod portions 48, 50 are preferably made from a thermoplastic acetyl resin such as Delrin 500, a tradename for this plastic which is available from E. I. DuPont de Nemours & Company.

The mushroom valve elements 44, 46 and the stopper mushroom valves 68 are preferably made from a silicone polymer plastic. For the vacuum stopper configuration, it is more preferred that the mushroom valve 68 be made of an acetyl resin such as Delrin 500 or other stiffer polymers such as ABS or a polycarbonate such as Lexan available from E. I. DuPont de Nemours & Company.

The stopper 70 may be manufactured from a compounded thermoplastic resin such as Kraton 2712G which is available from Shell Chemical Company or from its licensees under the trade name Empilon. The threaded cap 86 is manufactured of a hard clear acrylic styrene.

The portion of the plastic materials used in the construction of this pump for contact with foods and beverages should be suitable for use with such foods and beverages, and appropriate materials will have been approved by the U.S. Food and Drug Administration.

While the invention has been illustrated and described in what are considered to be the most practical and preferred embodiments, it will be recognized that many variations are possible and come within the scope thereof. The appended claims therefore being entitled to a full range of equivalents.

I claim:

1. A combination pressure and vacuum pump for food or drink containers comprising:
   - a pump housing containing a pump cylinder;
   - a pump head adapted for sealing engagement with a valve stopper on a food or drink container;
   - a piston in sliding airtight engagement with the pump cylinder, the pump cylinder, pump head and piston defining a pump chamber; and
   - a handle adapted for hand pumping to move the piston and the pump cylinder relative to one another;
   - the pump chamber including:
   - a first opening which connects to the valve stopper when the pump head is sealed to the valve stopper for pumping a gas into or out of the food or drink container, and
   - a second opening which connects to the atmosphere through a combination pressure and vacuum valve mounted therein, the combination valve being movable within said second opening to switch from a vacuum position to a pressure position.

2. The pump of claim 1 wherein the combination valve of said pump is slideable within said second opening to switch from a vacuum position to a pressure position.

3. The pump of claim 1 wherein said second opening of said pump chamber is in said piston and said combination valve is mounted therein.

4. The pump of claim 1 wherein the combination valve of said pump comprises a valve rod projecting through said pump chamber second opening and a pair of mushroom valve elements mounted on opposite ends of said valve rod.

5. The pump of claim 1 wherein said second opening of said pump chamber is in said piston and said combination valve comprises a valve rod projecting through said pump chamber second opening and a pair of mushroom valve elements mounted on opposite ends of said valve rod.

6. The pump of claim 1 wherein the combination valve of said pump comprises a valve rod projecting through said pump chamber second opening and a pair of mushroom valve elements mounted on opposite ends of said valve rod, each of the valve elements having flexible skirts around their perimeters for sealing said second opening, said valve rod having detents to hold one or the other of said mushroom valve elements to seal said second opening in either a vacuum position or a pressure position.

7. The pump of claim 1 wherein said second opening of said pump chamber is in said piston and the combination valve of said pump comprises a valve rod projecting through said pump chamber second opening and a pair of mushroom valve elements mounted on opposite ends of said valve rod, each of the valve elements having flexible skirts around their perimeters for sealing said second opening, said valve rod having detents to hold one or the other of said mushroom valve elements to seal said second opening in either a vacuum position or a pressure position.

8. The pump of claim 1 wherein the combination valve of said pump comprises a valve rod projecting through said pump chamber second opening and a pair of mushroom valve elements mounted on opposite ends of said valve rod, said valve rod having passageways therein for passage of air through said second opening.

9. The pump and stopper combination of claim 1 wherein said second opening of said pump chamber is in said piston and said combination valve comprises a valve rod projecting through said pump chamber second opening and a pair of mushroom valve elements mounted on opposite ends of said valve rod, said valve rod having passageways therein for passage of air through said second opening.

10. The pump of claim 1 wherein said pump head is removably secured to said pump housing to permit access to switch said combination valve between said vacuum position and said pressure position.

11. The pump of claim 1 wherein said combination valve includes a knob to switch said combination valve between said vacuum position and said pressure position and wherein said pump head is removably secured to said pump housing to permit access to the combination valve knob.

12. The pump of claim 1 wherein said pump head is removably secured to said pump housing to permit access to switch said combination valve between said vacuum position and said pressure position and is of conical configuration tapering inward to a central opening for sealing against said stopper.

13. The pump of claim 1 wherein said combination valve includes a knob having a downwardly extending opening to switch said combination valve between said vacuum position and said pressure position.

14. A combination pressure and vacuum valve stopper comprising:
   - a stopper for contacting an opening in a food or beverage container including: means for sealing the stopper to the opening in the food or beverage container, means for sealing the stopper to a pump head, and a valve opening through the stopper; and a valve element retained by the valve opening in the stopper, the valve element being reversible between a pressure position and a vacuum position to seal the valve opening.

15. The stopper of claim 14 wherein the valve element in said stopper comprises a mushroom valve on one side of said valve opening connected to a stop button on the other side of said valve opening by a valve rod.

16. The stopper of claim 14 wherein the valve element in said stopper comprises a mushroom valve on one side of said valve opening connected to a stop button on the other side of said valve opening by a valve rod, said mushroom valve having an extended tip for moving said valve element to the side to release vacuum in said container when said valve element is in the vacuum position.

17. A pump and stopper combination comprising:

a vacuum/pressure pump comprising:

a pump housing containing a pump cylinder;

a pump head adapted for sealing engagement with a valve stopper on a food or drink container;

a piston in sliding airtight engagement with the pump cylinder, the pump cylinder, pump head and piston defining a pump chamber; and a handle adapted for hand pumping to move the piston and the pump cylinder relative to one another;

the pump chamber including:

a first opening which connects to the valve stopper when the pump head is sealed to the valve stopper for pumping a gas into or out of the food or drink container, and a second opening which connects to the atmosphere through a combination pressure and vacuum valve mounted therein, the combination valve being moveable within said second opening to switch from a vacuum position to a pressure position; and a vacuum/pressure valve stopper comprising:

a stopper for contacting an opening in a food or beverage container including:

means for sealing the stopper to the opening in the food or beverage container, means for sealing the stopper to a pump head, and a valve opening through the stopper; and a valve element retained by the valve opening in the stopper, the valve element being reversible between a pressure position and a vacuum position to seal the valve opening.

18. The pump and stopper combination of claim 17 wherein the combination valve of said pump is slideable within said second opening to switch from a vacuum position to a pressure position.

19. The pump and stopper combination of claim 17 wherein said second opening of said pump chamber is in said piston and said combination valve is mounted therein.

20. The pump and stopper combination of claim 17 wherein the combination valve of said pump comprises a valve rod projecting through said pump chamber second opening and a pair of mushroom valve elements mounted on opposite ends of said valve rod.

21. The pump and stopper combination of claim 17 wherein said second opening of said pump chamber is in said piston and said combination valve comprises a valve rod projecting through said pump chamber second opening and a pair of mushroom valve elements mounted on opposite ends of said valve rod.

22. The pump and stopper combination of claim 17 wherein the combination valve of said pump comprises a valve rod projecting through said pump chamber second opening and a pair of mushroom valve elements mounted on opposite ends of said valve rod, each of the valve elements having flexible skirts around their perimeters for sealing said second opening, said valve rod having detents to hold one or the other of said mushroom valve elements to seal said second opening in either a vacuum position or a pressure position.

23. The pump and stopper combination of claim 17 wherein said second opening of said pump chamber is in said piston and the combination valve of said pump comprises a valve rod projecting through said pump chamber second opening and a pair of mushroom valve elements mounted on opposite ends of said valve rod, each of the valve elements having flexible skirts around their perimeters for sealing said second opening, said valve rod having detents to hold one or the other of said mushroom valve elements to seal said second opening in either a vacuum position or a pressure position.

24. The pump and stopper combination of claim 17 wherein the combination valve of said pump comprises a valve rod projecting through said pump chamber second opening and a pair of mushroom valve elements mounted on opposite ends of said valve rod, said valve rod having passageways therein for passage of air through said second opening.

25. The pump and stopper combination of claim 17 wherein said second opening of said pump chamber is in said piston and said combination valve comprises a valve rod projecting through said pump chamber second opening and a pair of mushroom valve elements mounted on opposite ends of said valve rod, said valve rod having passageways therein for passage of air through said second opening.

26. The pump and stopper combination of claim 17 wherein the valve element in said stopper comprises a mushroom valve on one side of said valve opening connected to a stop button on the other side of said valve opening by a valve rod.

27. The pump and stopper combination of claim 17 wherein the valve element in said stopper comprises a mushroom valve on one side of said valve opening connected to a stop button on the other side of said valve opening by a valve rod, said mushroom valve having an extended tip for moving said valve element to the side to release vacuum in said container when said valve element is in the vacuum position.

28. The pump and stopper combination of claim 17 wherein said pump head is removably secured to said pump housing to permit access to switch said combination valve between said vacuum position and said pressure position.

29. The pump and stopper combination of claim 17 wherein said combination valve includes a knob to switch said combination valve between said vacuum position and said pressure position and wherein said pump head is removably secured to said pump housing to permit access to the combination valve knob.

30. The pump and stopper combination of claim 17 wherein said pump head is removably secured to said pump housing to permit access to switch said combination valve between said vacuum position and said pressure position and is of conical configuration tapering inward to a central opening, and wherein said stopper has a lip for receiving and sealing against the conical portion of the pump head.

31. The pump and stopper combination of claim 17 wherein said combination valve includes a knob having a downwardly extending opening to switch said combination valve between said vacuum position and said pressure position, and wherein the valve element in said stopper comprises a mushroom valve on one side of said valve opening connected to a stop button on the other side of said valve opening by a valve rod, said mushroom valve having an extended tip for moving said valve element to the side to release vacuum in said container when said valve element is in the vacuum position, said tip extending upwardly and received within the opening of the knob when said pump is sealingly engaged with said valve stopper.

32. A combination pressure and vacuum pump comprising a pump housing containing a pump cylinder; a pump head on said housing; a piston in sliding airtight engagement with the pump cylinder; and a handle adapted for hand pumping to move the piston and the pump cylinder relative to one another, said piston having an opening which connects to the atmosphere through a combination pressure and vacuum valve mounted therein and slideable within the opening to switch from a vacuum position to a pressure position, the combination valve comprising a valve rod projecting through said piston opening and a pair of mushroom valve elements mounted on opposite ends of said valve rod, each of the valve elements having flexible skirts around their perimeters for sealing said opening, said valve rod having detents to hold one or the other of said mushroom valve elements to seal said opening in either a vacuum position or a pressure position.

33. The pump of claim 32 wherein said combination valve includes a knob to switch said combination valve between said vacuum position and said pressure position and wherein said pump head is removably secured to said pump housing to permit access to the combination valve knob.

34. The pump of claim 34 wherein said pump head is of conical configuration tapering inward to a central opening.

35. A combination pressure and vacuum valve stopper comprising a stopper for contacting and sealing with an opening in a container having a valve opening through the stopper and a valve element retained by the valve opening, said valve element including a mushroom valve on one side of said valve opening connected to a stop button on the other side of said valve opening by a valve rod, said valve element being reversible between a pressure position and a vacuum position to seal the valve opening.

36. The stopper of claim 35 wherein said mushroom valve has an extended tip for moving said valve element to the side to release vacuum in said container when said valve element is in the vacuum position.

* * * * *

UNITED STATES PATENT AND TRADEMARK OFFICE

CERTIFICATE OF CORRECTION

PATENT NO. : 5,031,785

DATED : JULY 16, 1991

INVENTOR(S) : ANTHONY R. LEMME

It is certified that error appears in the above-identified patent and that said Letters Patent is hereby corrected as shown below:

Col. 12, IN CLAIM 34, LINE 1, DELETE "34" AND SUBSTITUTE THEREFOR

-- 33 --.

Signed and Sealed this

Twenty-fourth Day of November, 1992

*Attest:*

DOUGLAS B. COMER

*Attesting Officer*

*Acting Commissioner of Patents and Trademarks*